US008381344B1

(12) United States Patent
Bergman et al.

(10) Patent No.: US 8,381,344 B1
(45) Date of Patent: Feb. 26, 2013

(54) HARD WATER DEPOSIT REMOVAL SYSTEM

(76) Inventors: Mickey Bergman, Laughlin, NV (US); Bob Wyndle, Laughlin, NV (US)

( * ) Notice: Subject to any disclaimer, the term of this patent is extended or adjusted under 35 U.S.C. 154(b) by 0 days.

(21) Appl. No.: 13/472,484

(22) Filed: May 16, 2012

(51) Int. Cl.
*A46B 13/02* (2006.01)

(52) U.S. Cl. ..... 15/1.7; 15/49.1; 15/97.1; 15/28

(58) Field of Classification Search ..... 15/93.1, 15/98, 22.1, 28, 97.1, 1.7, 49.1
See application file for complete search history.

(56) References Cited

U.S. PATENT DOCUMENTS 3,654,656 A 4/1972 Romagosa
4,286,675 A * 9/1981 Tuggle ..... 173/213
4,463,525 A 8/1984 Sheber
4,604,766 A 8/1986 Avery
4,881,978 A 11/1989 Van Horssen
5,074,004 A 12/1991 Patton et al.
5,511,269 A 4/1996 Watson
D390,705 S 2/1998 Reed
6,260,278 B1 * 7/2001 Faher ..... 30/276

* cited by examiner

*Primary Examiner* — Shay Karls

(57) ABSTRACT

A motorized deposit removal system with a pivoting rotary head has a generally rigid tubular housing with a power source located on a first end. The power source has a speed control unit. The system has a drive assembly with a drive cable and a cable housing located within the tubular housing. The power source rotates the drive cable freely inside the cable housing. The system has a hollow pivoting member located on a tubular housing second end. The pivoting member is able to be fixed at a specific angle. A rotary head attaching member is located on the pivoting member. The head attaching member is operatively attached to the drive cable. The drive assembly passes through the hollow pivoting member. The drive assembly is flexible for allowing for pivoting of the pivoting member. The system has a head attachment located on the head attaching member.

8 Claims, 6 Drawing Sheets

HARD WATER DEPOSIT REMOVAL SYSTEM

BACKGROUND OF THE INVENTION

In all likelihood, the first swimming pool was dug in Pakistan during the 3rd millennium BC. Since then, throughout history, swimming pools have increased in popularity, even finding their way into the back yards of many residences since the 1950s. Along with the use of swimming pools, also came a need for pool maintenance. Because of the dissolved solids found in the water used in swimming pools, deposits such as calcium are left behind due to the process of water evaporation. These deposits can be unsightly and tedious to clean. The present invention features a motorized deposit removal system having a pivoting rotary head for effectively removing hard water deposits such as calcium.

SUMMARY

The present invention features a motorized deposit removal system having a pivoting rotary head for effectively removing hard water deposits such as calcium. In some embodiments, the system comprises a generally rigid tubular housing having a power source located on a first end. In some embodiments, the power source has a speed control unit operatively attached. In some embodiments, the system comprises a drive assembly having a drive cable and a cable housing located within the tubular housing. In some embodiments, the power source rotates the drive cable. In some embodiments, the drive cable freely rotates inside the cable housing in a clockwise or a counter clockwise direction with regards to a cross-section of the tubular housing in a transverse plane.

In some embodiments, the system comprises a hollow pivoting member located on a tubular housing second end. In some embodiments, a rotary head attaching member is located on the pivoting member. In some embodiments, the pivoting member is able to be fixed at a specific angle. In some embodiments, the head attaching member is operatively attached to the drive cable. In some embodiments, the drive assembly passes through the hollow pivoting member. In some embodiments, the drive assembly is flexible for allowing for pivoting of the pivoting member.

In some embodiments, the system comprises a head attachment located on the head attaching member. In some embodiments, for operation, the pivoting member is set at an angle optimized for effective removal of deposits. In some embodiments, the power source rotates the drive cable within the cable housing. In some embodiments, the drive cable rotates the head attaching member. In some embodiments, the head attaching member rotates the head attachment located on the head attaching member. In some embodiments, the motorized deposit removal system having a pivoting rotary head is used to effectively remove deposits such as calcium.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
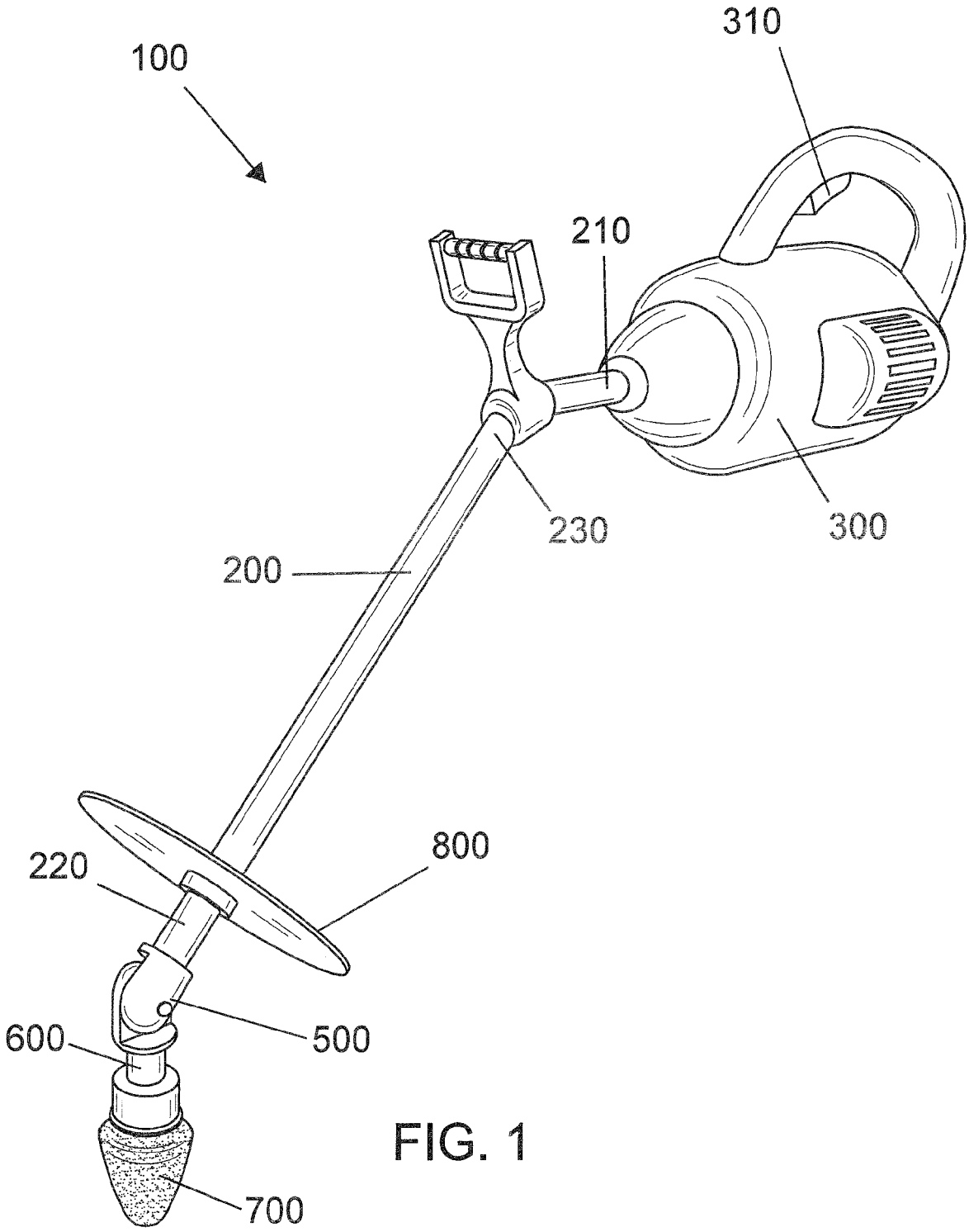
FIG. 1 is a perspective view of the present invention.
Figure 2:
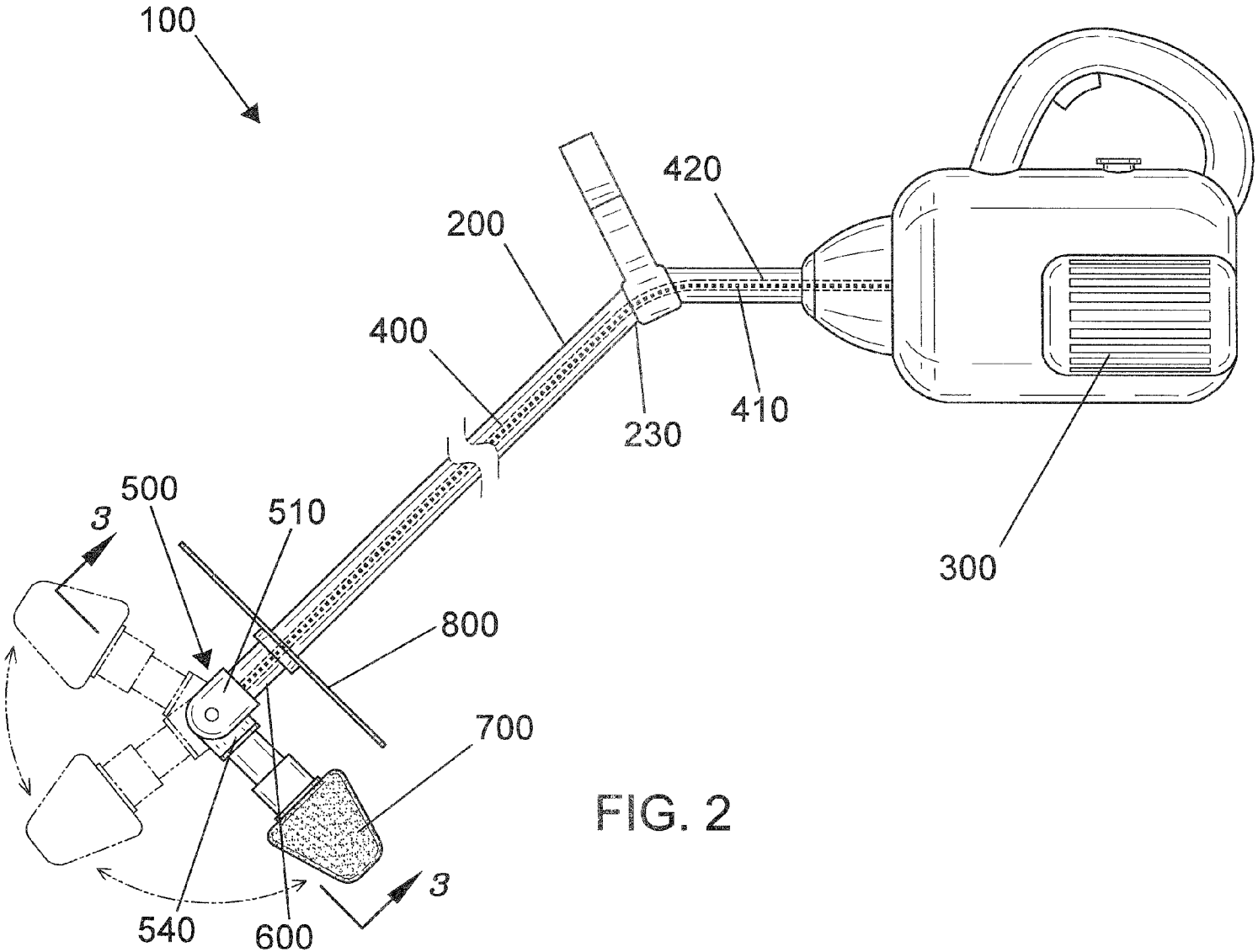
FIG. 2 is a side view of the present invention.
Figure 3:
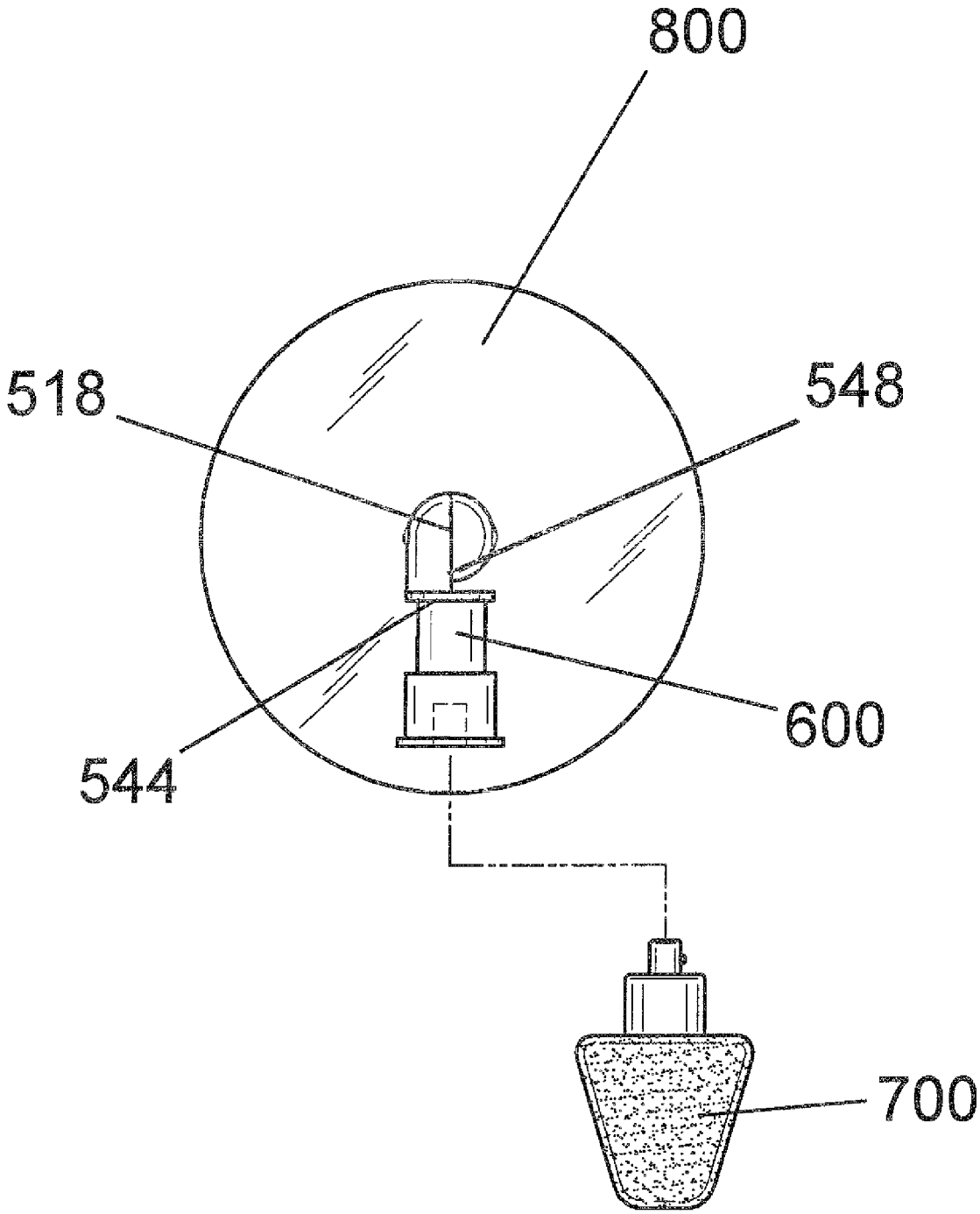
FIG. 3 is a bottom view of the present invention.
Figure 4A:
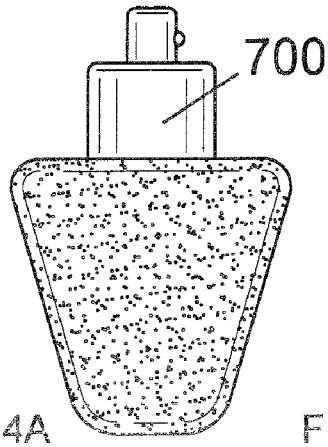
FIGS. 4A-4F are a front view of some alternate embodiments of the head attachment of the present invention.
Figure 4B:
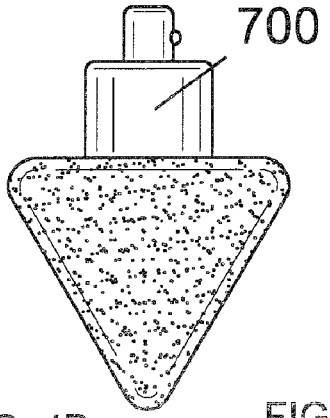
Figure 4C:
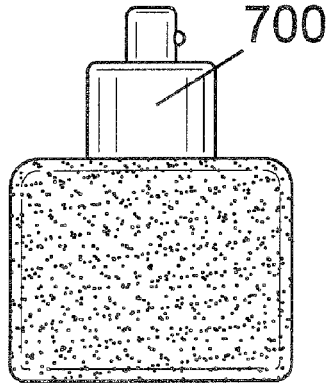
Figure 4D:
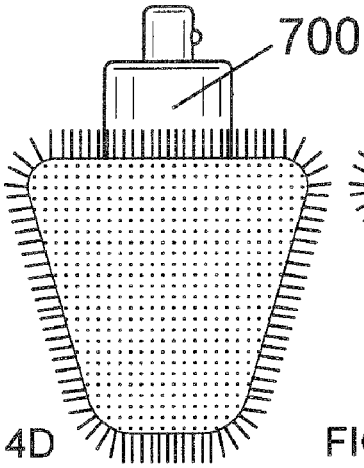
Figure 4E:
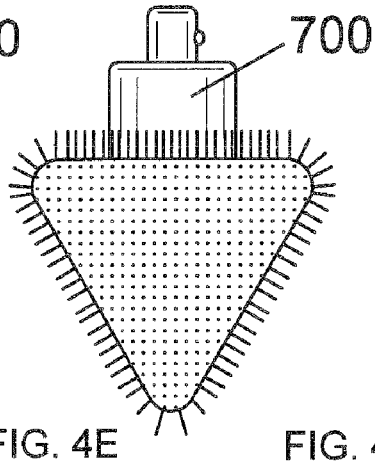
Figure 4F:
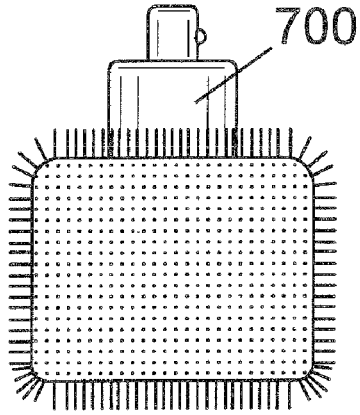
Figure 5:
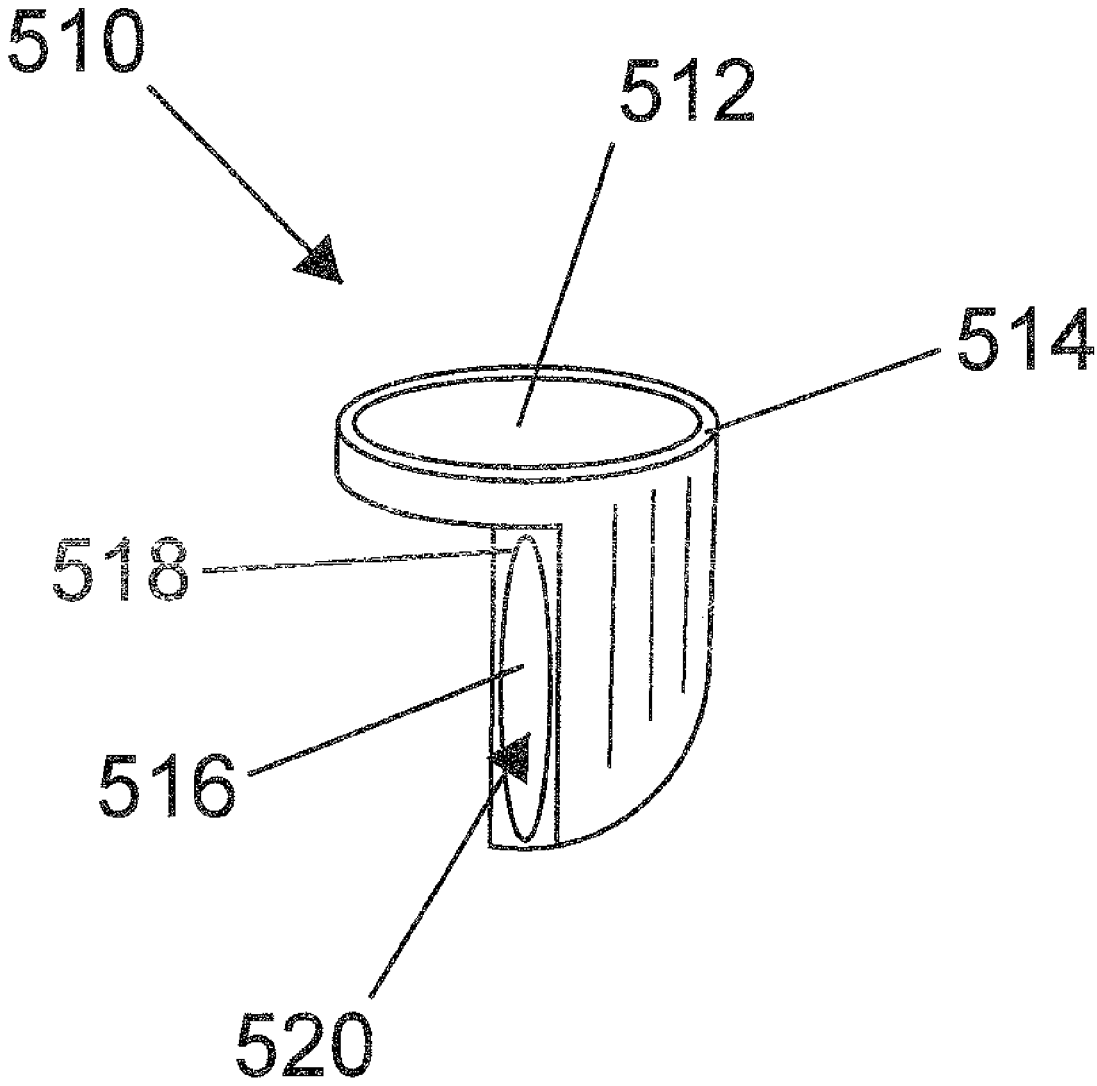
FIG. 5 is a perspective view of the pivoting member first component of the present invention.
Figure 6:
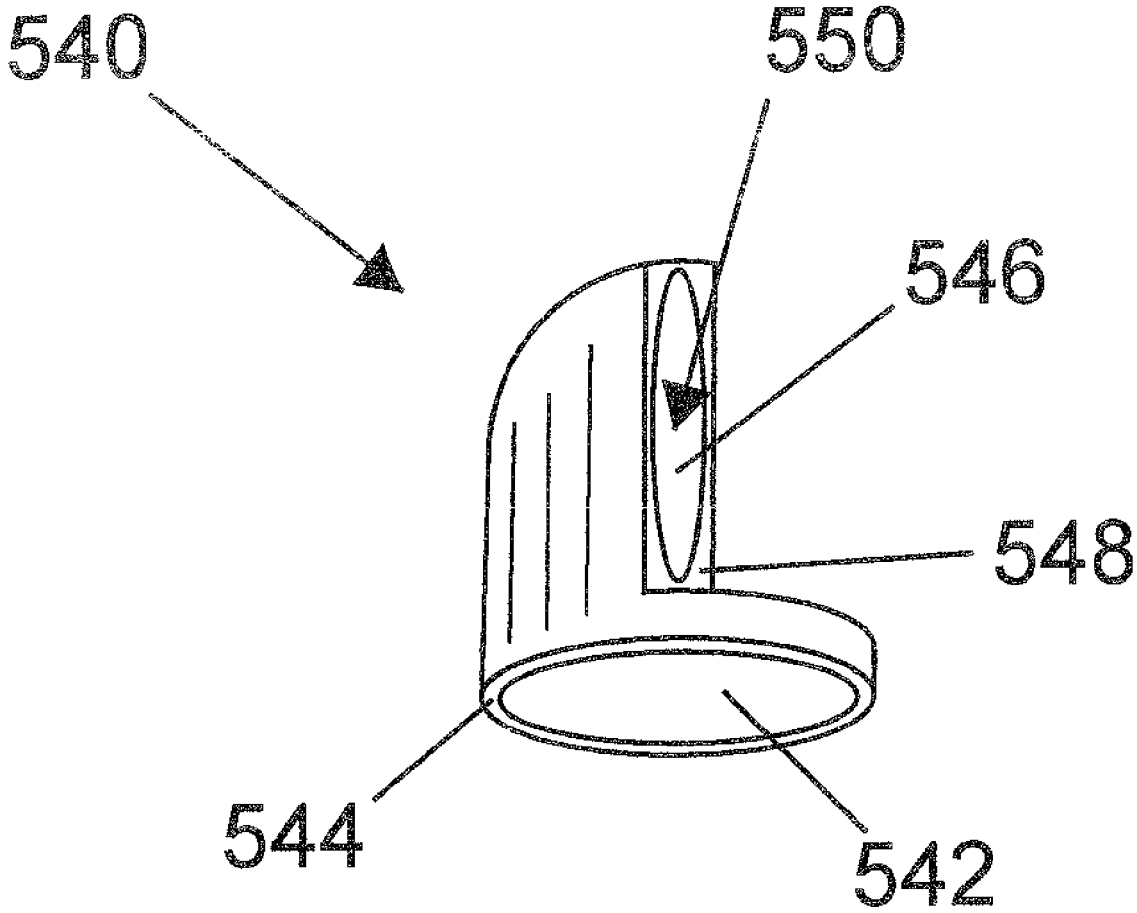
FIG. 6 is a perspective view of the pivoting member second component of the present invention.

Following is a list of elements corresponding to a particular element referred to herein:

100 Deposit removal system
200 Tubular housing
210 Tubular housing first end
220 Tubular housing second end
230 Tubular housing bend
300 Power source
310 Speed control unit
400 Drive assembly
410 Drive cable
420 Cable housing
500 Pivoting member
510 Pivoting member first component
512 First component aperture
514 Pivoting member top surface
516 First side aperture
518 Pivoting member first side surface
520 First component cavity
540 Pivoting member second component
542 Second component aperture
544 Pivoting member bottom surface
546 Second side aperture
548 Pivoting member second side surface
550 Second component cavity
600 Head attaching member
700 Head attachment
800 Safety shield Referring now to FIGS. 1-6, the present invention features a motorized deposit removal system (100) with a pivoting rotary head for effectively removing hard water deposits such as calcium. In some embodiments, the system (100) comprises a generally rigid tubular housing (200) having a power source (300) located on a tubular housing first end (210). In some embodiments, the power source (300) has a speed control unit (310) operatively attached thereto. In some embodiments, the tubular housing (200) comprises a tubular housing bend (230) located thereon in a middle area of the tubular housing (200).

In some embodiments, the system (100) comprises a drive assembly (400) having a drive cable (410) and a cable housing (420) located within the tubular housing (200). In some embodiments, the power source (300) is operatively attached to the drive cable (410). In some embodiments, the drive cable (410) freely rotates inside the cable housing (420) in a clockwise or a counter clockwise direction with regards to a cross-section of the tubular housing (200) in a transverse plane. In some embodiments the cable housing (420) is solidly attached to the tubular housing (200).

In some embodiments, the system (100) comprises a hollow pivoting member (500) located on a tubular housing second end (220) In some embodiments, a rotary head attaching member (600) is located on the pivoting member (500). In some embodiments, the pivoting member (500) is able to be solidly fixed at an angle and can be repositioned and solidly fixed at another angle. In some embodiments, the head attaching member (600) is operatively attached to the drive cable (410). In some embodiments, the drive assembly (400) passes through the hollow pivoting member (500).

In some embodiments, a hollow pivoting member first component (510) comprises a first component aperture (512) located on a pivoting member top surface (514) and a first side aperture (516) located on a pivoting member first side surface (518). In some embodiments, the first component aperture (512) is fluidly connected to the first side aperture (516) via a first component cavity (520) located inside the pivoting member first component (510).

In some embodiments, a hollow pivoting member second component (540) comprises a second component aperture (542) located on a pivoting member bottom surface (544) and a second side aperture (546) located on a pivoting member second side surface (548). In some embodiments, the second component aperture (542) is fluidly connected to the second side aperture (546) via a second component cavity (550) located inside the hollow pivoting member second component (540).

In some embodiments, the pivoting member first side surface (518) is rotatable and located on the pivoting member second side surface (548). In some embodiments, the first component aperture (512) interfaces and fluidly connects to the second component aperture (542). In some embodiments, the drive assembly (400) is flexible for allowing for pivoting of the pivoting member (500).

In some embodiments, the system (100) comprises a head attachment (700) that is rotatable and located on the head attaching member (600). In some embodiments, for operation, the pivoting member (500) is affixed at an angle optimized for effective removal of deposits. In some embodiments, the power source (300) rotates the drive cable (410) within the cable housing (420). In some embodiments, the drive cable (410) rotates the head attaching member (600). In some embodiments, the head attaching member (600) rotates the head attachment (700) located on the head attaching member (600). In some embodiments, the motorized deposit removal system (100) having a pivoting rotary head is used to effectively remove deposits such as calcium.

In some embodiments, the power source (300) is a gasoline engine.

in some embodiments, the tubular housing bend (230) is between 0 and 90 degrees.

In some embodiments, a safety shield (800) is located on the tubular housing (200) proximal to the tubular housing second end (220). In some embodiments, the safety shield (800) is transparent.

In some embodiments the system (100) is compact. In some embodiments, the system (100) is comparable in size to a typical hand held portable cordless drill or grinder.

In some embodiments, the power source (300) is 24 volts. In some embodiments, the power source (300) is between 12 and 24 volts. In some embodiments, the power source (300) is less than 12 volts. In some embodiments, the power source (300) is rechargeable.

In some embodiments, the head attachment (700) is a wire brush. In some embodiments, the head attachment (700) is constructed from a stone. In some embodiments, the head attachment (700) is constructed from plastic. In some embodiments, the head attachment (700) is constructed from a metal. In some embodiments, the head attachment (700) is constructed from a composite material.

In some embodiments, the power source (300) is reversible. In some embodiments, the power source (300) comprises two speeds.

In some embodiments, the system (100) is for cleaning pool tile, brick surfaces, concrete block surfaces, sidewalks, walls, buildings and other surfaces of deposits, debris, or graffiti.

As used herein, the term "about" refers to plus or minus 10% of the referenced number. For example, an embodiment wherein the housing is about 10 inches in length includes a housing that is between 9 and 11 inches in length.

The disclosures of the following U.S. patents are incorporated in their entirety by reference herein: U.S. Pat. No. D 390,705; U.S. Pat. No. 5,511,269; U.S. Pat. No. 5,074,004; U.S. Pat. No. 4,881,978; U.S. Pat. No. 4,604,766; U.S. Pat. No. 4,463,525; U.S. Pat. No. 3,654,656.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A motorized deposit removal system (100) having a pivoting rotary head for effectively removing hard water deposits such as calcium, wherein said system (100) comprises:

(a) a generally rigid tubular housing (200) having a power source (300) disposed on a tubular housing first end (210), wherein the power source (300) has a speed control unit (310) operatively attached thereto, wherein the tubular housing (200) comprises a tubular housing bend (230) disposed thereon in a middle area of the tubular housing (200);

(b) a drive assembly (400) having a drive cable (410) and a cable housing (420) disposed within the tubular housing (200), wherein the power source (300) is operatively attached to the drive cable (410), wherein the drive cable (410) freely rotates inside the cable housing (420) in a clockwise or a counter clockwise direction with regards to a cross-section of the tubular housing (200) in a transverse plane, wherein the cable housing (420) is affixedly attached to the tubular housing (200);

(c) a hollow pivoting member (500) disposed on a tubular housing second end (220), wherein a rotary head attaching member (600) is disposed on the pivoting member (500), wherein the pivoting member (500) is affixedly angularly positionable, wherein the head attaching member (600) is operatively attached to the drive cable (410), wherein the drive assembly (400) passes through the hollow pivoting member (500), wherein a hollow pivoting member first component (510) comprises a first component aperture (512) disposed on a pivoting member top surface (514) and a first side aperture (516) disposed on a pivoting member first side surface (518), wherein the first component aperture (512) is fluidly connected to the first side aperture (516) via a first component cavity (520) disposed inside the pivoting member first component (510), wherein a hollow pivoting member second component (540) comprises a second component aperture (542) disposed on a pivoting member bottom surface (544) and a second side aperture (546) disposed on a pivoting member second side surface (548), wherein the second component aperture (542) is fluidly connected to the second side aperture (546) via a second component cavity (550) disposed inside the hollow pivoting member second component (540), wherein pivoting member first side surface (518) is rotatably disposed on the pivoting member second side surface (548), wherein the first component aperture (512) interfaces and fluidly connects to the second component aperture (542), wherein the drive assembly (400) is flexible for allowing for pivoting of the pivoting member (500); and (d) a head attachment (700) removably disposed on the head attaching member (600);

wherein for operation, the pivoting member (500) is affixed at an angle optimized for effective removal of deposits, wherein the power source (300) rotates the drive cable (410) within the cable housing (420), wherein the drive cable (410) rotates the head attaching member (600), wherein the head attaching member (600) rotates the head attachment (700) disposed on the head attaching member (600), wherein the motorized deposit removal system (100) having a pivoting rotary head is used to effectively remove deposits such as calcium.

2. The system (100) of claim 1, wherein the power source (300) is a gasoline engine.

3. The system (100) of claim 1, wherein the tubular housing bend (230) is between 0 and 90 degrees.

4. The system (100) of claim 1, wherein the system (100) comprises a safety shield (800) disposed on the tubular housing (200) proximal to the tubular housing second end (220).

5. The system (100) of claim 4, wherein the safety shield (800) is transparent.

6. The system (100) of claim 1, wherein the head attachment (700) is a wire brush.

7. The system (100) of claim 1, wherein the head attachment (700) is constructed from a stone.

8. The system (100) of, claim 1, wherein the power source (300) is reversible.

* * * * *